US009453186B2

(12) United States Patent
Gorra et al.

(10) Patent No.: US 9,453,186 B2
(45) Date of Patent: Sep. 27, 2016

(54) ALL NATURAL DISHWASHING COMPOSITION COMPRISING LEMON POWDER AND VINEGAR POWDER

(71) Applicants: George A. Gorra, Aventura, FL (US); Leila R. Gorra, Aventura, FL (US)

(72) Inventors: George A. Gorra, Aventura, FL (US); Leila R. Gorra, Aventura, FL (US)

( * ) Notice: Subject to any disclaimer, the term of this patent is extended or adjusted under 35 U.S.C. 154(b) by 699 days.

(21) Appl. No.: 13/795,378

(22) Filed: Mar. 12, 2013

(65) Prior Publication Data

US 2013/0319471 A1 Dec. 5, 2013

Related U.S. Application Data

(60) Provisional application No. 61/653,592, filed on May 31, 2012.

(51) Int. Cl.

| | |
|---|---|
| ***C11D 7/44*** | (2006.01) |
| ***C11D 3/20*** | (2006.01) |
| ***A47L 15/42*** | (2006.01) |
| ***C11D 7/26*** | (2006.01) |
| ***C11D 3/382*** | (2006.01) |

(52) U.S. Cl.

CPC ..... *C11D 3/2082* (2013.01); *A47L 15/42* (2013.01); *C11D 3/2079* (2013.01); *C11D 3/2086* (2013.01); *C11D 3/382* (2013.01); *C11D 7/265* (2013.01); *C11D 7/44* (2013.01)

(58) Field of Classification Search

CPC . C11D 3/2075; C11D 3/2079; C11D 3/2082; C11D 7/44; C11D 11/0023; C11D 17/044

See application file for complete search history.

(56) References Cited

U.S. PATENT DOCUMENTS

| | | | | |
|---|---|---|---|---|
| 5,508,454 | A * | 4/1996 | Brancq | A61K 8/416 554/52 |
| 5,653,917 | A * | 8/1997 | Singerman | C02F 5/10 134/3 |
| 6,858,216 | B2 * | 2/2005 | Schulze zur Wiesche | A61K 8/4973 424/400 |
| 7,199,094 | B2 | 4/2007 | Cheung et al. | |
| 7,402,258 | B2 | 7/2008 | Kiehlbauch et al. | |
| 7,829,513 | B2 | 11/2010 | McCarthy et al. | |
| 8,182,858 | B2 * | 5/2012 | Toledo | A23B 4/12 426/120 |
| 2003/0050204 | A1 | 3/2003 | LaGraff et al. | |
| 2010/0099594 | A1 | 4/2010 | Bobnock | |
| 2010/0267192 | A1 | 10/2010 | Mei et al. | |
| 2010/0298189 | A1 * | 11/2010 | McCarthy | C11D 7/265 510/181 |
| 2013/0071535 | A1 * | 3/2013 | Fenyvesi | A61Q 5/02 426/534 |

OTHER PUBLICATIONS http://www.onegoodthingbyjillee.com/2012/02/homemade-dishwasher-detergent-revised.html.*
http://www.onegoodthingbyjillee.com/2012/01/homemade-dishwasher-detergent-and.html.
http://poppyjuice-poppy.blogspot.com/2012/03/vinegar-orange-peel-homemade-cleaning.html.
http://www.youtube.com/watch?v=jIJHEZItkkg.
http://greenliving.about.com/u/ua/greenathome/green-dishwashing-detergent-recipes.htm.

* cited by examiner

*Primary Examiner* — Charles Boyer
(74) *Attorney, Agent, or Firm* — Robert M. Schwartz; Ted Whitlock

(57) ABSTRACT

A dishwashing composition made by mixing vinegar powder and lemon powder for use in a dishwashing machine or for other cleaning purposes. The vinegar powder is mixed with the lemon powder in any of a variety of proportions. Both the lemon powder and the vinegar powder are non-toxic to humans and pets.

18 Claims, No Drawings

ALL NATURAL DISHWASHING COMPOSITION COMPRISING LEMON POWDER AND VINEGAR POWDER

CROSS-REFERENCE TO RELATED APPLICATION

This application claims priority from and the benefit of U.S. Provisional Patent Application Ser. No. 61/653,592 filed May 31, 2012, entitled Dishwashing Composition, as if the entire application were incorporated herein.

BACKGROUND OF THE INVENTION

The invention relates to a natural, non-toxic cleaning composition, substantially free from additives and preservatives. More particularly, the invention relates to a formulation of a cleaning composition which includes vinegar powder and lemon powder in any of a variety of proportions to be delivered in a measured pod or tablet form for use in an automatic dishwasher.

Many cleaning compositions are complex formulations of chemicals. Phosphates, oxygen based bleaching agents, chlorine-based bleaching agents, non-ionic surfactants, alkaline salts, anti-corrosion agents, sodium silicate, anti-foaming agents, ammonia, perfumes, anti-caking agents, starches, sand and other chemicals are commonly found in dishwashing detergents. Other prior art cleaning compositions are comprised of surfactants of various ionic charges (non-ionic, anionic and cationic), caustics, alcohols, and solvents.

Other prior art detergent formulations include harsh, synthetic and/or man-made chemicals. These and the above compounds could injure a person if ingested, or can be harmful to the environment when disposed with waste-water.

The current invention overcomes the disadvantages of the prior art by providing a cleaning composition, preferably useful in automatic dishwashing machines, which is safe to use, non-toxic to man or beast, and exceptionally cleans the dishes, and other objects which are desired to be cleaned.

SUMMARY OF THE INVENTION

The subject invention concerns a cleaning composition comprising lemon powder and vinegar powder. One embodiment of the composition of the invention is a cleaning composition useful as a dishwashing composition, and preferably useful as a dishwashing composition employed with the operation of an automatic dishwashing machine.

Preferably the lemon powder and vinegar powder ingredients are natural products, made or derived from a natural source, such as a plant source, e.g., lemon powder being derived from the fruit of a lemon tree and vinegar powder being derived from sugar cane. These natural-derived powders are advantageously useful in an automatic dishwasher for cleaning plates, silverware, food containers, or the like, used by humans and pets for eating and drinking, where it can be undesirable to use cleaners or detergents that contain harsh or harmful chemicals.

In a preferred embodiment, the subject invention therefore provides a dishwashing composition comprising:

a) lemon powder, and b) vinegar powder.

The dishwashing composition can be admixed to provide a substantially homogenous mixture composition. Preferably, the composition comprises lemon powder and vinegar powder which is 100% derived from a natural source. More preferably, the composition is 100% free of additives or preservatives.

The vinegar powder is commercially available, and is commonly derived from sugar cane. The vinegar powder is preferably provided in fine powder form, having about 18% acidity. The vinegar powder is preferably not prepared by freeze-drying process, but can be provided in freeze-dried form.

The lemon powder is also commercially available, and is commonly derived from lemons. In a preferred embodiment, the lemon powder is provided in lyophilized, or freeze-dried, form and has about 1.3% acidity.

The mixture of the composition can range from about 1-12 parts of vinegar powder to about 0.1-15 parts of lemon powder, by weight, wherein a preferred mixture for a dishwashing composition comprises about 9 parts vinegar powder to about 1 part lemon powder, by weight.

The mixture can also be added to or dissolved in an aqueous solution, preferably water, to provide a cleansing spray composition for cleaning items or household areas.

The subject invention further concerns a method of using a dishwashing composition in a dishwashing machine, said method comprising the steps of:

a) placing soiled dishes in said dishwashing machine, b) placing a sufficient amount of the dishwashing composition of the invention inside the dishwashing machine, and c) operating the dishwashing machine in accordance with instructions or recommendations provided by a dishwashing machine manufacturer.

The acidity of the lemon powder and the vinegar powder may be higher or lower based on application and other considerations. These two primary powder ingredients are preferably mixed together at a ratio of about nine (9) parts vinegar powder to one (1) part lemon powder. This admixed composition, in powder form, can be dispensed within the dishwasher, for example, in the bottom of the dish reservoir, or placed in the detergent dispenser provided as part of the dishwashing machine.

Alternatively, the powder can be compressed into a tablet shape, or contained in a water-soluble packaging means, such as a pod or packet or pouch (also known as a sachet), and the dishwashing machine can be operated in a conventional manner, pursuant to the operating instructions or recommendations for use provided by the manufacturer of the dishwashing machine.

The vinegar powder and lemon powder are comprised of a variety of chemical ingredients. Vinegar powder comprises, primarily, acetic acid ($HC_2H_3O_2$) which is a common component of liquid vinegar. Most over-the-counter vinegar products include about 5% acetic acid and 95% water.

Lemon powder primarily comprises citric acid ($H_3C_6H_5O_7$), which is found in lemons, limes, oranges, and other citrus fruits. Citric Acid constitutes about 8% of the dry weight of a lemon.

When the lemon powder and the vinegar powder are mixed with water in the dishwasher, both acetic acid and citric acid will be formed in a mild state. Both of these mild acids are non-toxic, and both are commonly consumed daily, without harm to a person consuming the acids.

During operation of a dishwashing machine employing a composition of the invention, the action of the water and mild acids provides unexpectedly improved cleansing action for dishes, without adverse consequences to a sewage system or septic tank used in the disposal of waste-water.

The composition of the invention can also be used as a general cleanser for cleaning floors, walls, or household items without damage to the item being cleaned or an item in the vicinity of the item being cleaned.

DETAILED DESCRIPTION OF THE INVENTION

The invention concerns a composition comprising a mixture of a first component being vinegar powder, and a second component being citrus powder, e.g., lemon powder, to be employed as a cleansing powder. Preferably, the composition is employed as a dishwashing cleaner for use in a dishwashing machine. Each of these two ingredients is preferably 100% derived from a natural source, preferably being substantially free, and more preferably being 100% free, of additives or preservatives.

This application refers to "vinegar powder" which is intended to mean powdered vinegar derived from any source, but preferably a natural source. It is understood that acetic acid is the primary active ingredient or component of "vinegar powder." Therefore, reference herein to "vinegar powder" is intended to encompass a powder form of vinegar, acetic acid, or a powder comprising acetic acid as its major component.

This application also refers to "lemon powder" which is intended to mean a powder derived from a citrus fruit, such as a lemon, lime, orange, tangerine, or the like, which has a relatively high concentration of citric acid compared to other natural sources. Accordingly, "lemon powder," "citrus powder", or "citric acid powder," can be used interchangeably and refer to a powder form of citric acid derived from a natural source, such as citrus fruit.

It is also understood that the vinegar powder and citrus powder can be synthetically derived using well-known chemical processes. These synthetic powders are also part of the invention, though natural source-derived powders are preferred.

In a preferred embodiment, the first component and second component are provided as a dry mixture in proportions ranging from about 1:1 to about 10:1 ratio of vinegar powder:citrus powder. Most preferred is a composition comprising a dry mixture of the first and second components at about nine (9) parts vinegar powder to one (1) part lemon powder. This composition is a preferred embodiment which works well in an automatic dishwashing machine.

It is contemplated that the mixture of vinegar powder with lemon powder may have additional uses especially in the cleaning arts. When such a mixture is mixed with water and placed in a spray bottle, a non-toxic spray cleaner for glass, metal, counter tops, refrigerators, sinks, bathrooms and the like is provided. The mixture of vinegar powder and lemon powder comprises a scent which is mild and aesthetically pleasant to the sense of smell. The composition can also be used as an additive to other dishwashing products.

By altering the ratio of the first portion of the vinegar powder with the second portion of lemon powder, one may change the characteristics of the cleaning composition, allowing it to be used to clean other items. The composition may be employed in a clothes washing machine at one proportion of the mixture.

Being mildly acidic, the composition of the invention may also be useful as a safe, non-toxic material for opening clogged drains.

In certain concentrations at certain proportions, the mixture may be once again dissolved in water and could be sprayed on exposed limbs at an outdoor party, acting as an insect repellent. The mixture at other concentrations may be employed to keep insects out of the house or perhaps away from an outdoor party.

The mixture in other proportions may also be mixed with bath water to give the bather a soothing bath.

There are undoubtedly many other uses for the mixture of vinegar powder and lemon powder. The examples here are in no way comprehensive, merely giving a general idea of the many possible uses this invention has. These examples are by no means limiting and are not intended to be comprehensive with respect to the mixture of vinegar powder and lemon powder.

Additionally, the ratios of the vinegar powder to lemon powder described above are in no way limiting to the desired ratios of the invention. Although many uses may share the same ratio, other uses would employ other ratios. This invention contemplates the use of any possible ratio of vinegar powder to lemon powder being mixed together.

Several examples also described dissolving the mixture in water. This is in no way limiting either. It could be dissolved in any fluid which it is soluble in at any proportion and the uses such a composition are considered well within the scope of the invention.

Additionally, the mixture of vinegar powder with lemon powder may form the base for mixing in another or multiple powders. Further, these additional ingredients may form the basis for products which may include the group of cleaning products, but may also belong to other groups or sets of products. An example of such a mixture may be vinegar powder with lemon powder (at any appropriate proportion) mixed with a pharmaceutical. Such a mixture could be formed into a tablet, a liquid or other device to introduce a medicine or pharmaceutical into a human or animal.

Further, there are several physical properties of a white vinegar powder that has been considered for use in this invention. First, the white vinegar powder is preferably derived from sugarcane as known in the art, where it is from a fermented process made from sugar cane. Secondly, the white vinegar powder has an acidity of between 12-18.68 g/100 g, which infers 12-18.68 grams of acetic acid to 100 grams of white vinegar powder. It is to be understood that other sources and supplies of both white vinegar powder, lemon powder, acetic acid, citric acid, as well as any other ingredient either discussed or claimed exist and that this application contemplates the utility of their use if so desired. It is also contemplated in alternative embodiments that citric acid can be derived from other sources of naturally occurring citrus acid.

It is also contemplated that the natural ingredients will be from fresh lemons and fresh sugar cane. Preferably, the composition is 100% derived from natural sources.

In use, the preferred composition of vinegar powder and lemon powder is place in a pod or packet or pouch encased by a water soluble outer material such as a water-soluble or water-disintegrable paper or polymeric covering, for containing the powder of the composition. Such packets are sometimes referred to and would be readily recognized in the art as "sachets."

Alternatively, the composition can be compressed to form a tablet which can be easily handled by a user. The tablet formation can include a binder or compression enhancer to facilitate the manufacturing process, or to facilitate holding the tablet together in unit doses for storage, shipping, or the like. A tablet comprising the subject composition as described herein can further include commonly used tablet ingredients, such as fillers, solubilizers, or the like, and can be coated with a clear, white, or color coating to provide integrity to the tablet or for an aesthetically pleasing look or feel to the tablet when handled by the user.

Preferably, the packet, pod or tablet containing the composition is provided as a single-use amount to be placed in the dishwasher prior to washing the dishes or other containers or items to be cleaned in the dishwasher. In use, the composition has cleaned dishes and glasses providing exceptional cleanliness, even when the dishes and containers were exceptionally soiled with hard-to-clean or dried-on foods.

Following the CLAIMS and ABSTRACT is an APPENDIX. The APPEXDIX is the material safety data sheets (MSDS) from the manufacturers of the ingredients and certificates of analysis (COA) from the manufacturers of the ingredients used in the preferred embodiment of this invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A dishwashing composition comprising:

a) lemon powder substantially free of additives or preservatives, and b) vinegar powder having acidity of about 12% to about 18%.

2. The dishwashing composition of claim 1, wherein the lemon powder and vinegar powder are admixed to provide a substantially homogenous mixture composition.

3. The dishwashing composition as claimed in claim 1 wherein 100% of said lemon powder and said vinegar powder is derived from a natural source.

4. The dishwashing composition as claimed in claim 3 wherein said vinegar powder is derived from sugar cane.

5. The dishwashing composition as claimed in claim 1 wherein said lemon powder is derived from lemon and is substantially free of preservatives or additives.

6. The dishwashing composition as claimed in claim 1 wherein said lemon powder is freeze dried.

7. The dishwashing composition as claimed in claim 1, wherein said dishwashing composition comprises 1-12 parts of said vinegar powder to 0.1-15 parts of said lemon powder, by weight.

8. The dishwashing composition as claimed in claim 6 wherein said dishwashing composition comprises about 9 parts of said vinegar powder and about 1 part of said lemon powder, by weight.

9. The dishwashing composition of claim 1 wherein the composition is free of additives and preservatives.

10. A method of using a dishwashing composition in a dishwashing machine, said method comprising the steps of:

a) placing soiled dishes in said dishwashing machine, b) placing a sufficient amount of the dishwashing composition of claim 1 inside said dishwashing machine, and c) operating said dishwashing machine in accordance with instructions or recommendations provided by a dishwashing machine manufacturer.

11. A dishwashing composition consiting essentially of:

a) lemon powder substantially free of additives or preservatives, and b) vinegar powder having acidity of about 12% to about 18%.

12. The composition of claim 11, wherein said vinegar powder and said lemon powder are provided at a ratio of about 1:1 to about 10:1, by weight.

13. The composition of claim 12, wherein said ratio of vinegar powder:lemon powder is about 9:1.

14. A cleansing spray composition comprising:

a) lemon powder substantially free of additives or preservatives, and b) vinegar powder having acidity of about 12% to about 18%, wherein the powders are dissolved in an aqueous solution.

15. The spray composition of claim 14, wherein the aqueous solution is water.

16. The spray composition of claim 14, wherein the ratio of vinegar powder to lemon powder is about 1:1 to about 10:1.

17. The composition of claim 16 wherein the ratio of vinegar powder: lemon powder is about 9:1.

18. The composition of claim 15 wherein said lemon powder is natural lemon powder derived from a lemon and is substantially free of preservatives or additives.

* * * * *